US008371321B2

(12) United States Patent
Affolter

(10) Patent No.: US 8,371,321 B2
(45) Date of Patent: Feb. 12, 2013

(54) POOL SHADE

(75) Inventor: Dennis R. Affolter, Grain Valley, MO (US)

(73) Assignee: Dennis R. Affolter, Grain Valley, MO (US)

( * ) Notice: Subject to any disclaimer, the term of this patent is extended or adjusted under 35 U.S.C. 154(b) by 297 days.

(21) Appl. No.: 12/798,472

(22) Filed: Apr. 5, 2010

(65) Prior Publication Data

US 2010/0258153 A1 Oct. 14, 2010

Related U.S. Application Data

(60) Provisional application No. 61/212,169, filed on Apr. 8, 2009.

(51) Int. Cl.
*E04H 15/20* (2006.01)
*E04H 4/00* (2006.01)

(52) U.S. Cl. ..... 135/96; 135/116; 135/117; 135/121; 4/499; 4/494; 441/38

(58) Field of Classification Search ..... 135/96, 135/114, 116, 117, 137, 121; 4/494, 946, 4/498, 488, 499–501; 441/32, 38, 42, 129, 441/131; 114/345–346, 364
See application file for complete search history.

(56) References Cited

U.S. PATENT DOCUMENTS

| | | | | |
|---|---|---|---|---|
| 1,643,464 | A * | 9/1927 | McCullers | 114/263 |
| 3,167,793 | A * | 2/1965 | Keats | 441/22 |
| 3,660,855 | A * | 5/1972 | Inman | 441/6 |
| 3,760,441 | A * | 9/1973 | Handelman | 441/11 |
| 3,769,639 | A * | 11/1973 | Bishop | 4/498 |
| 3,802,007 | A * | 4/1974 | Dolan, Jr. | 441/136 |
| 5,299,588 | A * | 4/1994 | MacLeod | 135/16 |
| 5,505,645 | A * | 4/1996 | Engler, Jr. | 441/1 |
| 6,595,861 | B1 * | 7/2003 | Morrow et al. | 472/134 |
| 6,981,680 | B1 * | 1/2006 | Gordon et al. | 248/346.01 |
| 7,878,478 | B2 * | 2/2011 | Gumm | 248/529 |

FOREIGN PATENT DOCUMENTS

JP 04031577 A * 2/1992

* cited by examiner

*Primary Examiner* — Winnie Yip

(57) ABSTRACT

A free floating canopy shade system for use in a pool or at a beach. The canopy has four legs each leg supported by an open top float, each float having an outer tapered cylindrical wall and an inner cylindrical wall, the inner cylindrical wall being sized to receive a leg, an attachment to attach the leg to the float. The float being water tight and open at the top. Wherein an open shaded area is created beneath the canopy bounded only on four corners by each float.

10 Claims, 5 Drawing Sheets

POOL SHADE

CROSS REFERENCES TO RELATED APPLICATIONS

Applicant claims priority under 35 USC 119 c to provisional application 61/212,169 filing date Apr. 8, 2009.

STATEMENT AS TO RIGHTS TO INVENTIONS MADE UNDER FEDERALLY SPONSORED RESEARCH AND DEVELOPMENT

Not Applicable

BRIEF DESCRIPTION OF THE PRIOR ART

It is known to provide shade for people in the water by providing inflatable floatation devices with shade. These are typically very small and intended for individual use. U.S. Pat. No. 4,248,255 is an example. The result is very limited shade that does not even cover one entire person. The shade further requires that the person remain on the floatation device.

Patent application 2003/0046755 discloses a somewhat larger arrangement but the shade is very confining. A person has to remain laying down. Also the shade takes up a large area so that others in the pool have little space to move around and enjoy the pool.

U.S. Pat. No. 5,505,645 discloses a one pole sun shade with a drink holder and anchor 13. This patent allows for greater movement but still provides a small area of shade and is very prone to blow over in a strong wind.

As can be seen, there is a need for an improved system for providing shade for people in the water.

SUMMARY OF THE INVENTION

The present invention is directed to a free floating canopy shade system for use in a pool comprising a canopy having four legs each leg supported by a float. Each float has an outer cylindrical wall and an inner cylindrical wall, the inner cylindrical wall being sized to receive a leg. An attachment to attach each leg to the float, the float being water tight and open at the top. Wherein an open shaded area is created beneath the canopy bounded only on four corners by each float.

DESCRIPTION OF THE PREFERRED EMBODIMENT

Figure 1:
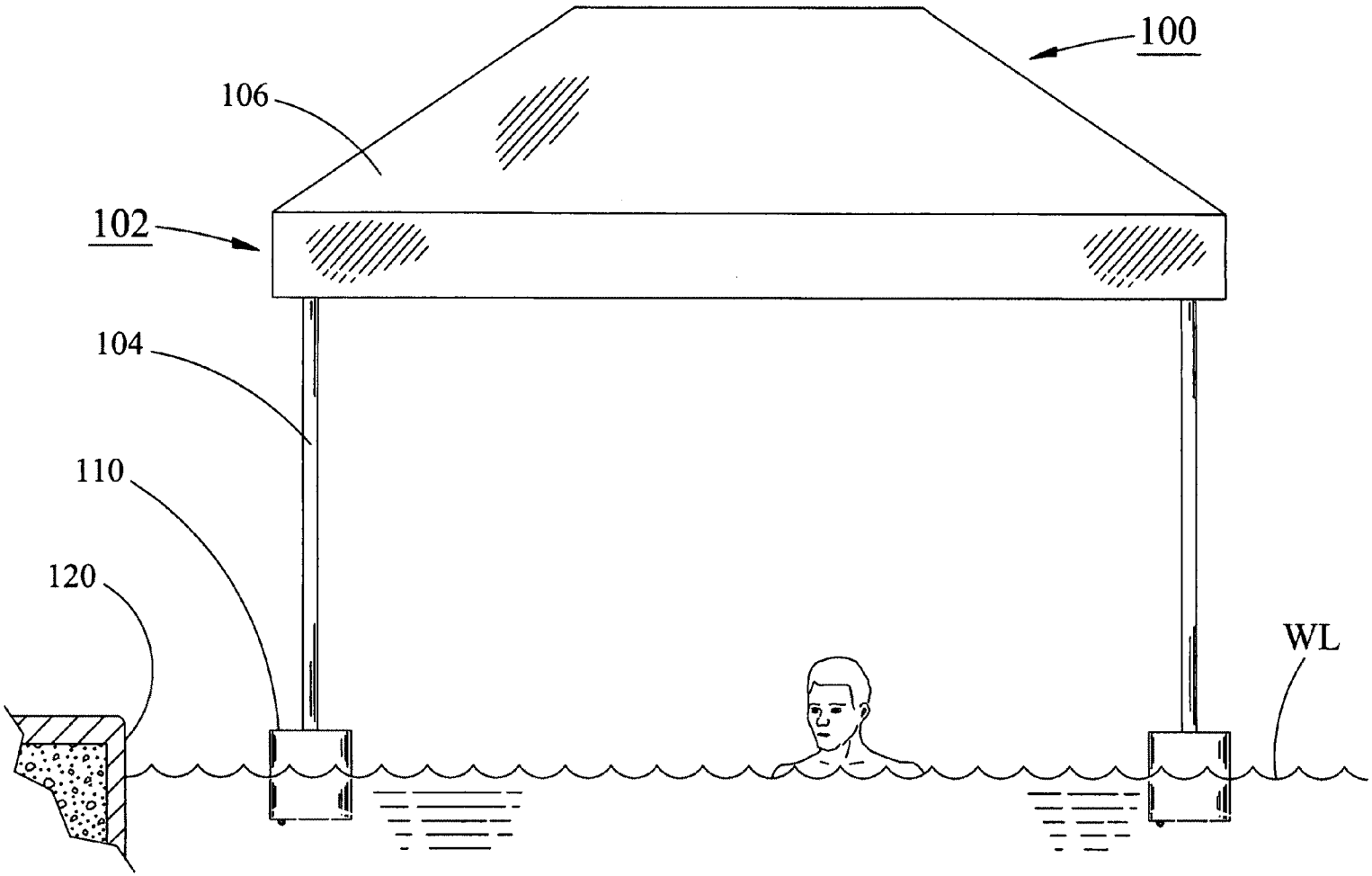
FIG. 1 shows a view of the present invention in use.

In accordance with the present invention, FIG. 1 shows a view of the portable canopy shade system 100 in use. The canopy shade system 100 includes a frame 102 with four legs 104 and a canopy 106 stretched on the frame 102. The canopy system 100 also includes four corner floats 110 each cylindrical corner float 110 supports a leg 104. As can be seen the canopy system 100 can float in a pool 120. The light weight canopy system 100 will weigh less than 100 pounds so that the corner floats 110 can take up less than one square foot of pool surface area per supported leg 104 and less than one cubic foot of pool water is displaced by each float. Many commercially available four leg canopies are less than 50 pounds. The result is a canopy 106 that can provide a large area of shade perhaps 8 ft by 8 ft (64 square feet) while taking up a very small area of the surface of the pool (less than 4 square feet) for example. Further because the sides are open the canopy system 100 provides uninterrupted, unobstructed access to the pool in and out of the shaded area. The system 100 floats with the corner floats 110 nearly on top of the water line WL. The system 100 is designed so that it can use a conventional shade canopy 106 that are available for use now on patios. The canopy frame 102 might bolt together or fold up. The system 100 can be installed by first assembling the canopy 106 and legs 104 like it would be used on a patio. Then moving one person gets in the water with the 4 floats 110. The person on the edge of the pool 120 can move the canopy 106 so that the first 2 legs 104 hang down into the pool 120. Corner floats 110 are placed on these legs 104 then the first two legs can be floated out into the pool 120 until the person in the water can place corner floats 110 on the other two legs 104. The canopy system 100 can be removed from the pool 120 by reversing the process. Alternatively the floats 110 can be attached to the legs 104, using ties or clips to retain the corner floats 110 on the legs 104 while it is placed in the pool 120.

Figure 2:
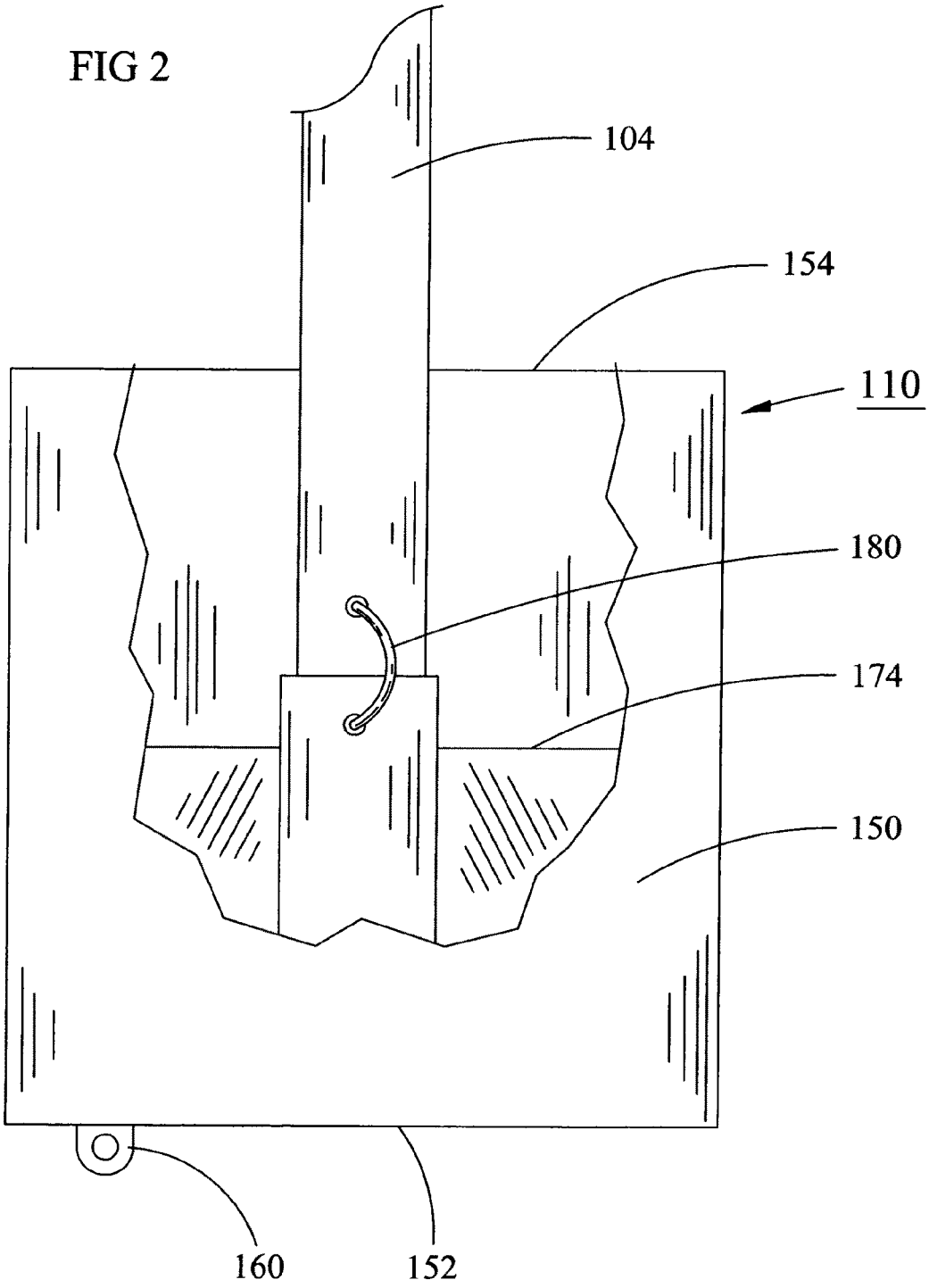
FIG. 2 shows details of a portion of the invention.

FIG. 2 shows details of a corner float 110 with a leg 104 in place. The float 110 includes a cylindrical wall 150 shown partially cut away to show the inside of the corner float 110. The float 110 includes a solid bottom 152 and an open top 154. The cylindrical side wall 150 can be slightly tapered from top to bottom to allow the floats 110 to nest together for shipping for example the open top can have a 10 inch diameter and the bottom 152 can have a diameter of 9 inches. A float 110 includes an attachment point such as an eye 160 on the bottom surface 152 such that an anchor weight can be attached if desired.

FIG. 2 shows that the inside of the corner float 110 includes an inner cylinder 170 that is generally concentric with the outer wall 150 and that includes an opening in the top 172 (FIG. 3) sized to receive leg 104. The inner cylinder 170 can include molded support walls 174. The corner float 110 can be molded in one piece or the inner cylinder 170 and supports can be assembled into the float 110. Each corner float 110 can include an attachment such as a tie 180 that allows the float 110 to be tied to the leg 104 or some other point on the canopy 102. The float 110 can be retained on the leg 104 if the leg fits tight in the inner cylinder 170.

Figure 3:
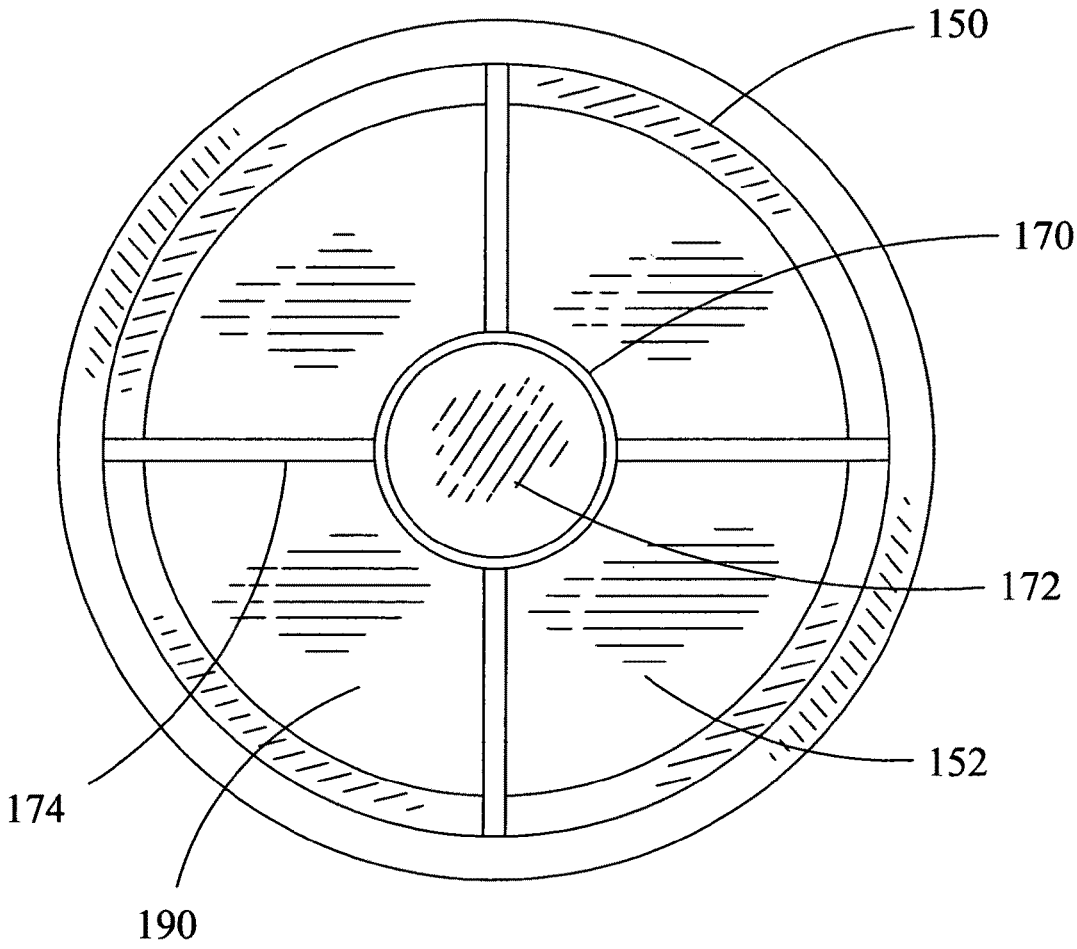
FIG. 3 shows details of a portion of the invention.

FIG. 3 shows the corner float 110 interior with the leg 104 removed. The outer wall 150, bottom 152 and radial supports walls 174 can form 4 pie shaped sections 190. The pie shaped sections 190 can be water tight such that a section 190 can be used to contain items such as drinks or personal items such as a shirt, watch or billfold. It is also possible to fill one or several pie sections with water, sand or other material such that the canopy system 100 has more weight such as might be required on a windy day or if the canopy system 100 were to be used at the beach. The float 110 can also be filled with ice and used as a cooler so it is possible to have one corner float 110 for a cooler and another of the four floats for dry storage.

Figure 4:
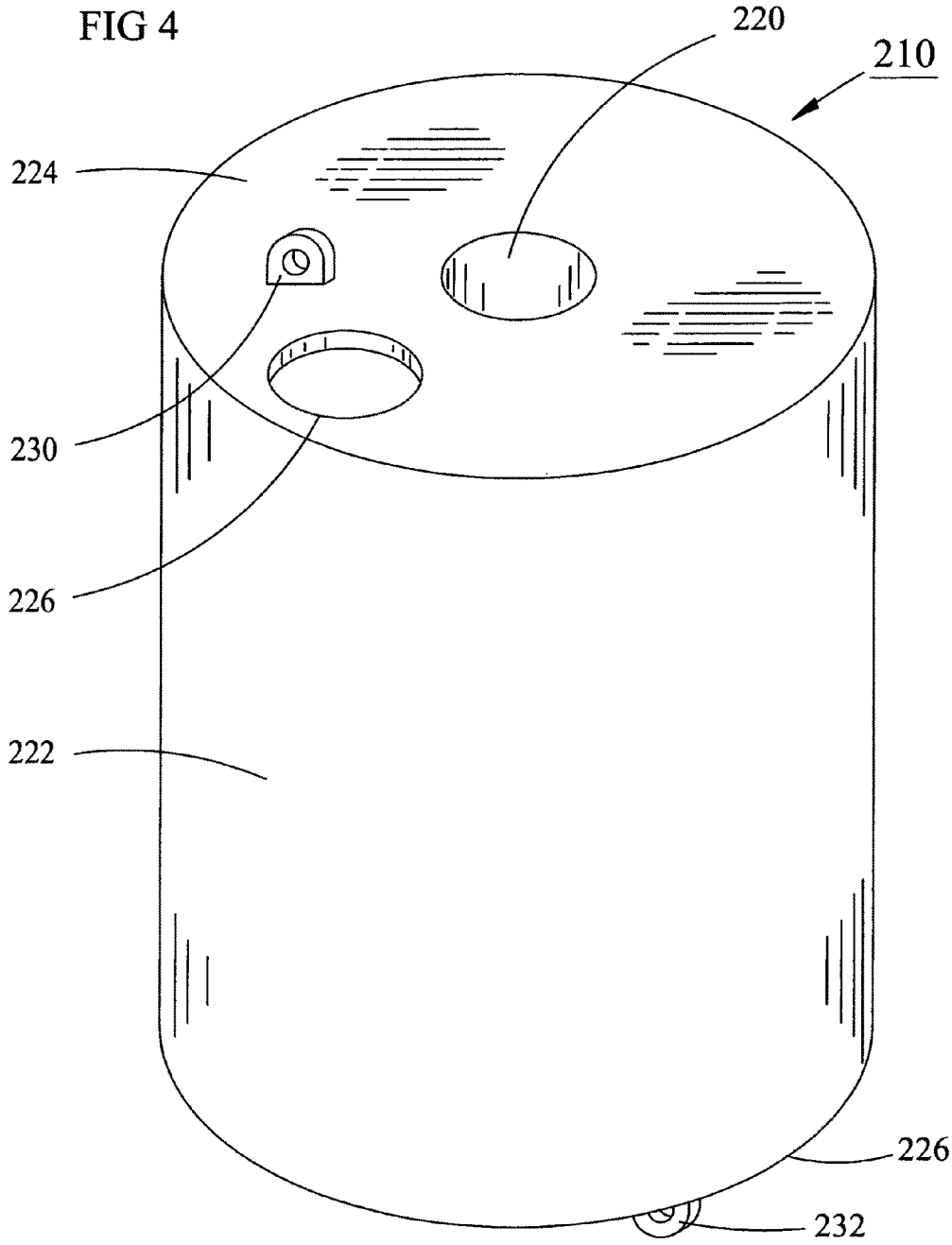
FIG. 4 shows an alternate embodiment of the invention.

FIG. 4 shows an alternate embodiment of the corner float 210 where the float 210 is a closed container. The closed container float 210 also includes an opening 220 which can be the top of a closed cylinder sized to receive the leg 104 within the float 210. The closed corner float 210 includes a side wall 222, a top 224 and a bottom surface 226. A top attachment point 230 allows the float 210 to be tied to a leg 104 and a bottom attachment point 232 allows for the attachment of an anchor. A third embodiment of the corner float could be achieved by leaving off the bottom surface 226 and simply allowing the float to float on air trapped in the float by the wall 222 and top 224. The top 224 can include a recess 226 such as a drink holder.

Figure 5:
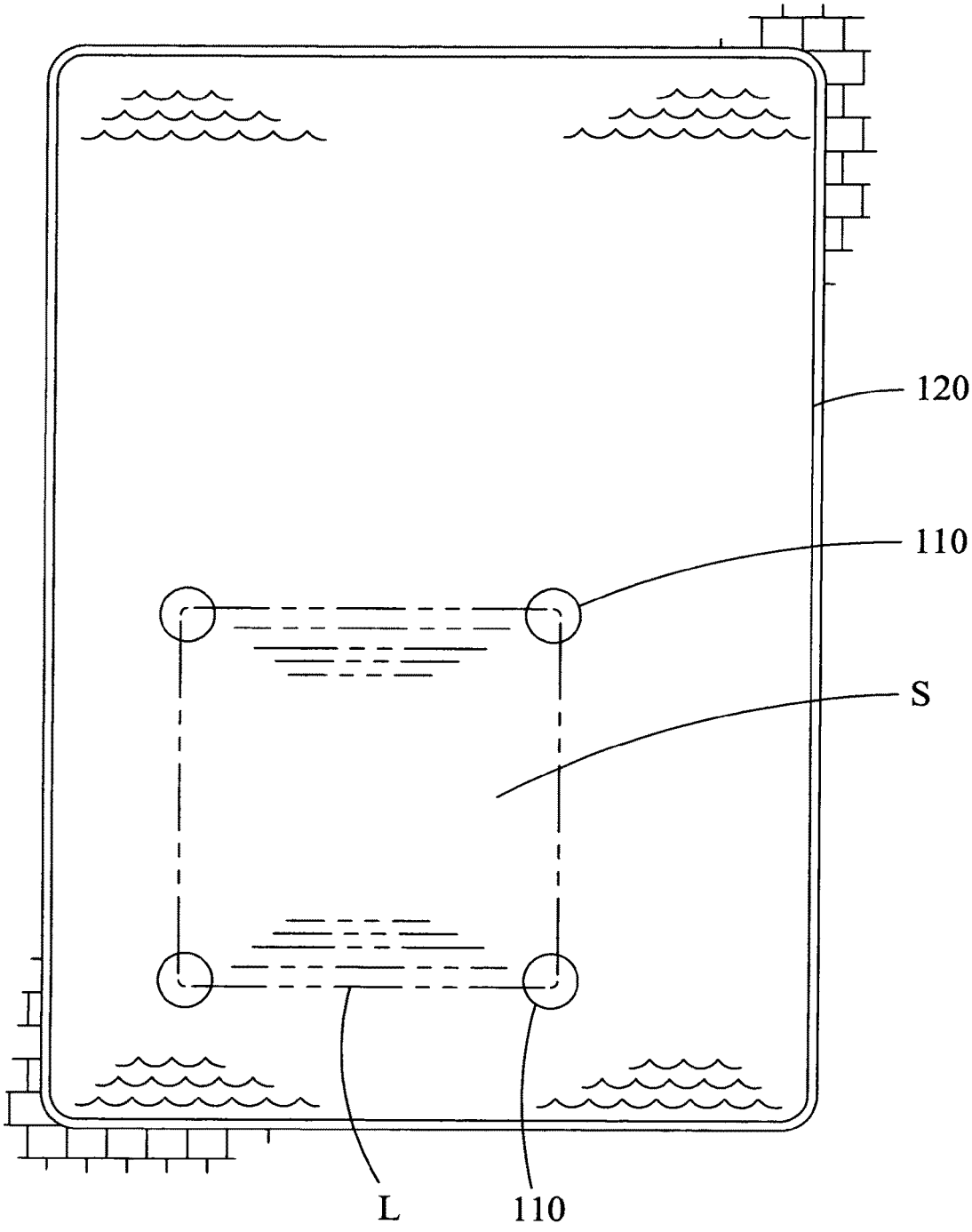
FIG. 5 shows an overhead view.

FIG. 5 shows a plan view of the pool 120 with the area (S) shaded by the canopy 106 indicated by dashed lines L. As can be seen the corner floats 110 provide access for a person to move in and out of the shades area S with unobstructed movement. The open lines L between the corner floats 110 allow for the pool 120 to be used in any way that it could without the canopy system 100 in place. The floats 110 take up only about ½-2% of the area contained between the floats 110.

Although the description above contains many specificities, these should not be construed as limiting the scope of the invention but as merely providing illustrations of some of the presently preferred embodiments of this invention. As such, it is understood that the present invention is not limited to the embodiments described above, but encompasses any and all embodiments within the scope of the claims.

It will be obvious to those skilled in the art that modifications may be made to the embodiments described above without departing from the scope of the invention. Thus the scope of the invention should be determined by the claims in the formal application and their legal equivalents, rather than by the examples given.

I claim:

1. A free floating canopy shade system for use in a pool comprising;

a canopy having four legs each leg supported by a float placed on the water, each float having a top opening and having an outer cylindrical wall and an inner cylindrical wall resting on a bottom, the inner cylindrical wall being sized to receive one of the legs through said top opening, said inner cylindrical wall being supported by radial walls connecting the inner cylindrical wall to the bottom and to the outer cylindrical wall, said float being water tight and open at the top; said top opening allows items to be placed within the float adjacent the leg during use of the float;

wherein an open shaded area is created beneath the canopy bounded only on four corners by each said float.

2. The free floating canopy shade system of claim 1 wherein each said float can be nested inside another float for storage.

3. The free floating canopy shade system of claim 1 wherein said each float can be used as a cooler or for dry storage.

4. The free floating canopy shade system of claim 1 wherein said float includes an attachment to attach said leg to said float.

5. The free floating canopy shade system of claim 1 wherein each said float has a volume less than one cubic foot and said volume is contained within said outer cylindrical wall.

6. A free floating canopy shade system comprising;

a canopy having a plurality of legs each leg supported by a float, each float having an opening and having an outer cylindrical wall and an inner cylindrical wall, the inner cylindrical wall being sized to receive one of the legs through the opening, said inner cylindrical wall being supported by radial walls connecting the inner cylindrical wall to the outer cylindrical wall, each said float being water tight and open at the top; said opening allowing items to be placed within each said float adjacent the leg during use and wherein said outer cylindrical wall and a bottom on said outer cylindrical wall define a volume of the float and;

wherein an open shaded area is created beneath the canopy bounded only on corners by each said float and wherein the canopy is used on a solid surface standing on the floats or in water floating on said floats.

7. The free floating canopy shade system of claim 6 wherein said float includes an attachment to attach said leg to said float.

8. The free floating canopy shade system of claim 7 wherein one float can be used as a cooler and a second used for dry storage.

9. The free floating canopy shade system of claim 7 wherein each said float can be nested inside another float for storage.

10. The free floating canopy shade system of claim 7 wherein said volume of each said float is less than one cubic foot.

* * * * *